US007373720B1

(12) United States Patent
Jensen et al.

(10) Patent No.: US 7,373,720 B1
(45) Date of Patent: May 20, 2008

(54) FIRE SPRINKLER FLEXIBLE PIPING SYSTEM, BRACING APPARATUS THEREFOR, AND METHOD OF INSTALLING A FIRE SPRINKLER

(76) Inventors: Raymond H. Jensen, 295 E. Swedesford Rd., #280, Wayne, PA (US) 19087-1462; Erik T. Jensen, 295 E. Swedesford Rd., #280, Wayne, PA (US) 19087-1462

( * ) Notice: Subject to any disclaimer, the term of this patent is extended or adjusted under 35 U.S.C. 154(b) by 0 days.

(21) Appl. No.: 11/384,862

(22) Filed: Mar. 20, 2006

(51) Int. Cl.
*B21D 51/16* (2006.01)
*A62C 35/00* (2006.01)

(52) U.S. Cl. ..... 29/890.143; 29/890.144; 169/13; 169/16; 169/37; 169/41

(58) Field of Classification Search ..... 29/890.143, 29/890.144; 239/201, 209, 587.1; 169/13, 169/16, 37, 38, 41, 52; 137/357, 580; 285/127.1
See application file for complete search history.

(56) References Cited

U.S. PATENT DOCUMENTS 750,932 A * 2/1904 Baird ..... 137/357
838,972 A * 12/1906 Foreman ..... 137/293
871,574 A * 11/1907 Dorgan ..... 285/119
1,826,072 A * 10/1931 Hamilton ..... 169/17
4,785,887 A * 11/1988 Miller ..... 169/37
5,040,729 A * 8/1991 Carrozza ..... 239/201
5,396,959 A * 3/1995 Macdonald ..... 169/51

* cited by examiner

*Primary Examiner*—David P. Bryant
*Assistant Examiner*—Alexander P Taousakis
(74) *Attorney, Agent, or Firm*—John F. A. Earley, III; Frank J. Bonini, Jr.; Harding, Earley, Follmer & Frailey, P.C.

(57) ABSTRACT

A bracing apparatus for bracing a flexible pipe extending between a fire sprinkler header pipe and a sprinkler and for holding the sprinkler in a desired location, a flexible piping system having the bracing apparatus, and a method of installing a sprinkler of a sprinkler system having the bracing apparatus. The bracing apparatus has first mounting members that attach to a flexible pipe, and a stiffener bar that extends between the first and second mounting members.

9 Claims, 2 Drawing Sheets

FIRE SPRINKLER FLEXIBLE PIPING SYSTEM, BRACING APPARATUS THEREFOR, AND METHOD OF INSTALLING A FIRE SPRINKLER

BACKGROUND OF THE INVENTION

1. Field of the Invention

The present invention relates to fire sprinkler systems, and in particular to a flexible piping system for a ceiling tile fire sprinkler installation.

2. Brief Description of the Prior Art

Fire sprinkler systems carry a fire suppressing agent, commonly water, from a source into a building through a network of pipes. The piping network operates under pressures as high as 150-200 psi, and transient pressures can be even higher. Thus, the network must be sufficiently supported so that the components of the system are not compromised due to the fluctuations in pressure. Typically, the network of piping for fire sprinkler systems is located within the building or infrastructure above the ceiling, typically a drop ceiling, or ceiling tiles, and the sprinkler ends protrude through holes formed in the ceiling tiles. The sprinkler ends are connected to fire sprinkler distribution headers (sprinkler pipes) by means of rigid metal pipe and associated fittings. During construction or installation, the distribution header is installed. The metal pipe connections from the distribution header to the sprinkler, and the sprinklers themselves, are installed at a later time, usually after the ceiling support system is in place and the openings are formed in the ceiling tiles. Once the ceiling grid system is in place and the location of the tiles and openings are known, the fire sprinkler installation crew then returns to size the rigid pipe connections from the header to the sprinkler. The sprinklers are then installed. This method slows installation in that the sprinkler installation crew must fit and install the distribution header and estimate locations of the branch pipe connections. At this point, they must wait until the ceiling support system and tiles are in place before they can complete installing the connecting pipes and sprinkler fittings. Another drawback associated with having to wait until ceiling installation is complete is that pressure testing cannot be done until the complete system, and thus the ceiling, is installed, making it more difficult to isolate and repair leaks in the distribution system.

It is recently known in the art to use flexible pipe to distribute the flow from the distribution header to the sprinkler fitting. However, these systems require adequate support, usually from the ceiling tile support grid system, for the sprinkler fittings to stay in place during pressure variations in the system.

SUMMARY OF THE INVENTION

It is an object of the invention to provide a flexible piping system for a fire sprinkler installation that provides rigidity while positioning a fire sprinkler of the system in a position that approximates the location where the center of a ceiling tile will be located when the tile is installed.

It is another object of the invention to provide a flexible piping system for a fire sprinkler installation that may be installed and tested (e.g., hydro tested) in both new and retro construction prior to the installation of a grid system for supporting ceiling tiles.

It is a further object of the invention to provide a flexible piping system for a fire sprinkler installation that is not dependant upon the ceiling tile grid system for support.

These and other objects are provided by the invention, preferred embodiments of which are described below.

DETAILED DESCRIPTION OF SEVERAL EMBODIMENTS

Figure 1:
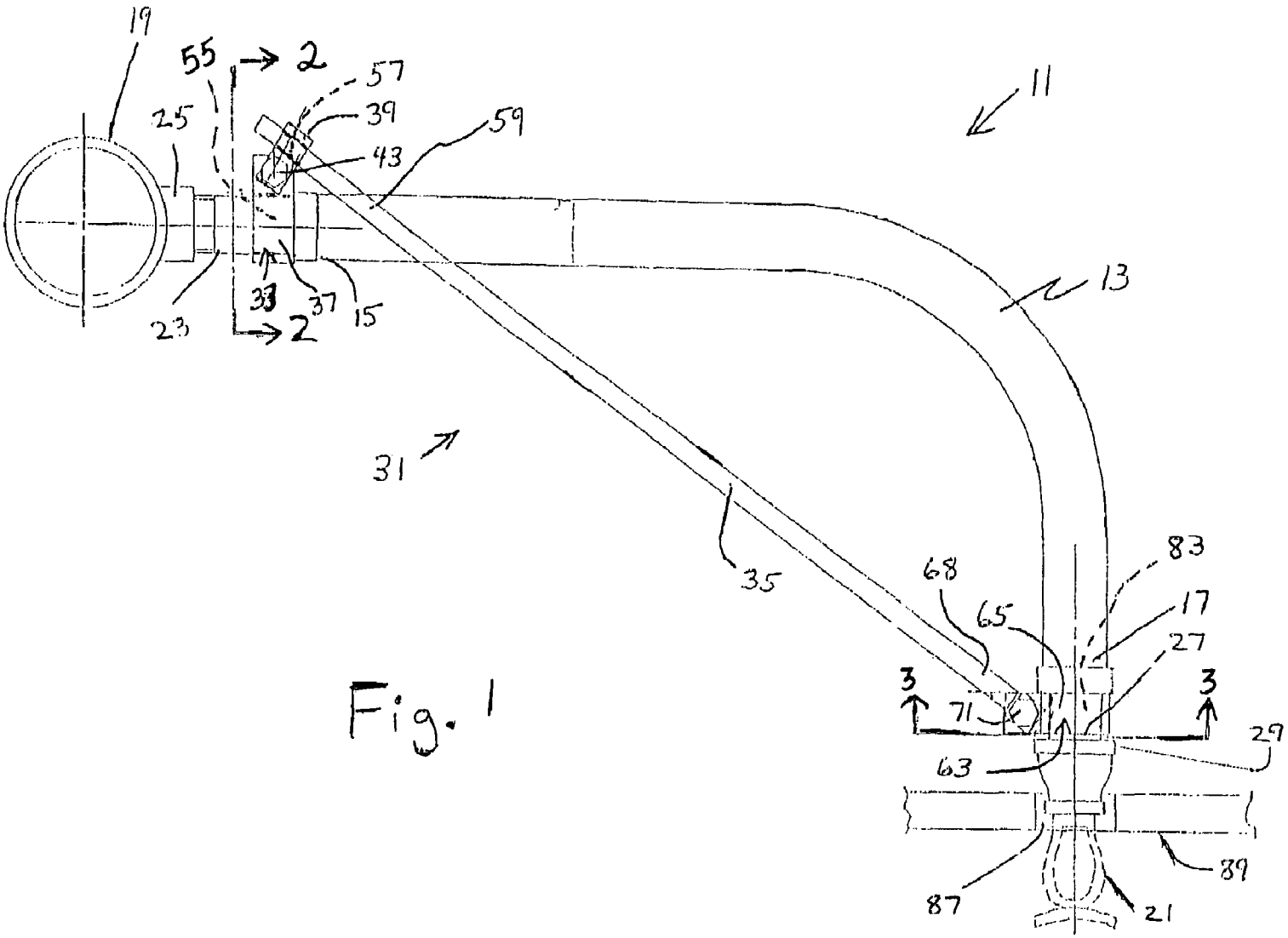
FIG. 1 is a view in front elevation showing the flexible piping system constructed in accordance with the invention.
Figure 2:
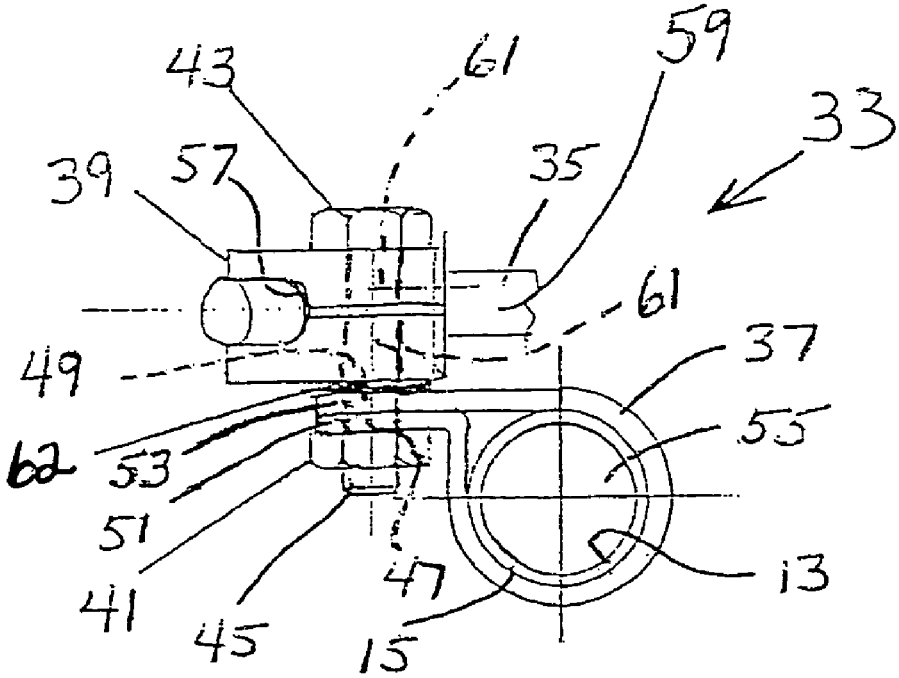
FIG. 2 is an enlarged sectional view taken along the lines and arrows 2-2 of FIG. 1.
Figure 3:
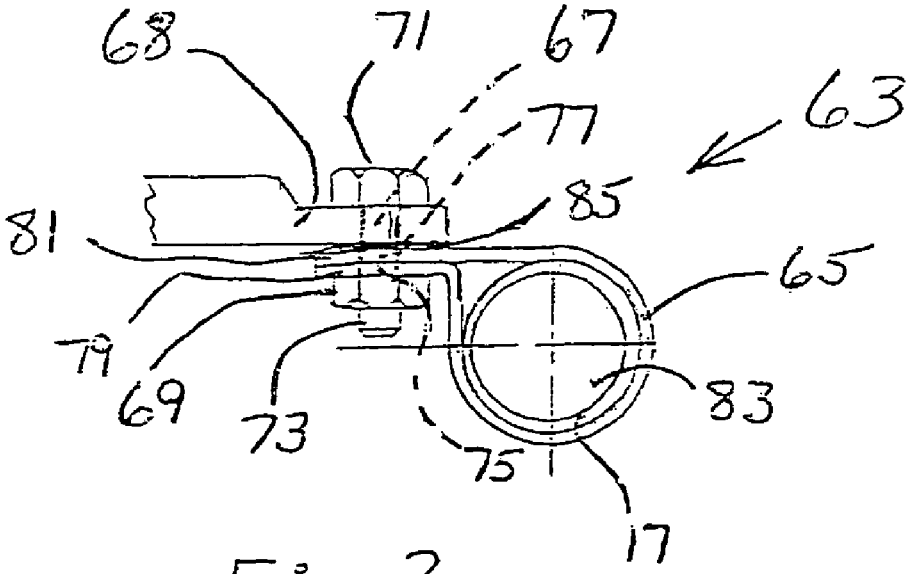
FIG. 3 is an enlarged sectional view taken along the lines and arrows 3-3 of FIG. 1.

Turning now to the drawings, that are shown in FIGS. 1, 2, and 3 a flexible piping system 11 for a ceiling tile fire sprinkler installation constructed in accordance with the invention. A flexible pipe 13 is provided having a first end portion 15 and a second end portion 17, and the flexible pipe 13 is used for conveying a fire suppressing fluid, typically water, from a fire sprinkler header pipe (e.g., branch line or cross main) 19 to a sprinkler 21. As shown, the first end portion 15 of the flexible pipe 13 attaches to the header pipe 19, and the second end portion 17 of the flexible pipe 13 attaches to the sprinkler 21. Preferably, the first end portion 15 of the flexible pipe 13 has a male pipe threaded nipple 23 which engages a female threaded fitting 25 on the header pipe 19, and the second end portion 17 of the flexible pipe 13 has a male pipe threaded nipple 27 which engages a reducing coupling 29 to which the sprinkler 21 attaches. The use of the reducing coupling 29 permits the use of various orifice sized sprinklers 21. Preferably, the flexible pipe 13 is a flexible stainless steel braided pipe.

A bracing apparatus 31 is provided for bracing the flexible pipe 13 and for positioning the sprinkler 21 in a desired location. The bracing apparatus 31 includes a first mounting member 33 adapted to engage the first end portion 15 of the flexible pipe 13 and adapted to engage a bracing or stiffener rod or bar 35. The first mounting member 33 has a pipe clamp 37, a trunion clamp 39, a nut 41, and a bolt 43 having a nut receiving end portion 45. As shown in the drawings, and in particular FIG. 2, the pipe clamp 37 has aligned first and second bolt openings 47, 49 formed in opposing end flanges 51, 53 for receiving the bolt 43. The pipe clamp 37 also has a pipe opening 55 for receiving the first end portion 15 of the flexible pipe 13.

The trunion clamp 39 has a first bore 57 for slidably receiving the first end portion 59 of the stiffener bar 35. The trunion clamp 39 also has a second bore 61 for receiving the bolt 43.

When the first end portion 15 of the flexible pipe 13 is positioned in the pipe opening 55 of the pipe clamp 37 and the bolt 43 passes through the second bore 61 of the trunion clamp 39 and the first and second bolt openings 49, 47 of the of the pipe clamp 37, by sufficiently tightening the nut 41 onto the nut receiving end portion 45 of the bolt 43, the stiffener bar 35, at a selected location along the length of the stiffener bar 35, may be compressibly secured in the first bore 57 of the trunion clamp 39 and the pipe clamp 37 may be compressibly secured around the first end portion 15 of the flexible pipe 13. Preferably, a washer 62 is placed on bolt 43 between the trunion clamp 39 and the flanges 51, 53 of the pipe clamp 37.

The bracing apparatus 31 also includes a second mounting number 63 adapted to engage the second end portion 17 of the flexible pipe 13 and adapted to engage the stiffener bar 35. The second mounting member 63 has a pipe clamp 65, a nut 69, and a bolt 71 having a nut receiving end portion 73. As shown in the drawings, and in particular FIG. 3, the pipe clamp 65 has aligned first and second bolt openings 75, 77 formed in opposing end flanges 79, 81 for receiving the bolt 71. The pipe clamp 65 also has a pipe opening 83 for receiving the second end portion 17 of the flexible pipe 13.

When the second end portion 17 of the flexible pipe 13 is positioned in the pipe opening 83 of the pipe clamp 65 and the bolt 71 passes through bore 67 formed in the second end portion 68 of the stiffener bar 35 and through the opposing first and second bolt openings 77, 75 of the pipe clamp 65, the pipe clamp 65 may be compressibly secured around the second end portion 17 of the flexible pipe 13 by sufficiently tightening the nut 69 onto the nut receiving end portion 73 of the bolt 71. The sufficient tightening of the nut 69 onto the nut receiving end portion 73 of the bolt 71 also secures the second end portion 68 of the stiffener bar 35 in place, preventing angular or pivotal movement of the stiffener bar 35 around the second mounting member 63. With sufficient tightening of the nut 69 onto the bolt 71, the angle between the stiffener bar 35 and the second mounting member 63 is set due to the stiffener bar 35 being squeezed between the nut 69 and the flanges 79, 81 of the pipe clamp 65. Preferably, a washer 85 is placed on bolt 71 between the stiffener bar 35 and the flanges 79, 81 of the pipe clamp 65.

Preferably, the pipe clamps 37 and 65, the stiffener bar 35, the nipples 23 and 27, the reducing coupling 29, the trunion clamp 39, the bolts 43 and 71, the nuts 41 and 69, and the washers 62 and 85 are made of steel.

In use, the flexible piping system of the invention may be installed as follows. The installer approximates the position of where the sprinkler 21 is to be installed, and then sizes the flexible pipe 13 such that its length is sufficient to extend from the fitting 25 of the fire sprinkler header pipe 19 to the approximate location for the sprinkler 21. The first end portion 15 of the flexible pipe 13 may then be connected to the fire sprinkler header pipe 19 by threading the nipple 23 into the fitting 25.

The first mounting member 33 may be attached to the first end portion 15 of the flexible pipe 13 by placing the pipe clamp 37 around the first end portion 15 of the flexible pipe 13 such that the first end portion 15 of the flexible pipe 13 is located in the pipe opening 55, positioning the trunion clamp 39 next to the pipe clamp 37, inserting the bolt 43 through the bore 61 in the trunion clamp and through the bolt openings 49 and 47 in the pipe clamp 37, and threading the nut 41 onto the nut receiving portion 45 of bolt 43 to attach the pipe clamp 37 around the first end portion 15 of the flexible pipe 13 and to connect the trunion clamp 39 to the pipe clamp 37. Preferably, a washer 62 is positioned on the bolt 43 between the trunion clamp 39 and the end flange 53 of the pipe clamp 37. At this stage of the installation procedure, the nut 41 is tightened onto the bolt 43 only to the extent that the first mounting member 33 is loosely attached to the first end portion 15 of the flexible pipe 13 and may be rotated around the first end portion 15 of the flexible pipe 13.

Next, the second mounting member 63 may be attached to the second end portion 17 of the flexible pipe 13 by placing the pipe clamp 65 around the second end portion 17 of the flexible pipe 13 such that the second end portion 17 of the flexible pipe 13 is located in the pipe opening 83 of the pipe clamp 65, inserting the bolt 71 through the bore 67 in the second end portion 68 of the stiffener bar 35 and preferably through the washer 85 and then through the first and second bolt openings 77 and 75 of the pipe clamp 65, and then tightening the nut 69 onto the nut receiving end portion 73 of the bolt 71 to attach the pipe clamp 65 around the second end portion 17 of the flexible pipe 13 and to connect the stiffener bar 35 to the pipe clamp 65. At this stage of the installation, the nut 69 is tightened onto the bolt 71 only to the extent that the second mounting member 63 is loosely attached to the second end portion 17 of the flexible pipe 13 and may be rotated around the second end portion 17 of the flexible pipe 13.

Next, the first end portion 59 of the stiffener bar 35 may be inserted through the bore 57 in the trunion clamp 39, wherein it is slidably received until the nut 41 is further tightened onto bolt 43 to tighten the trunion clamp 39 around the stiffener bar 35 and to secure the stiffener bar 35 in a fixed position with respect to the first mounting member 35.

Next, the sprinkler 21 may be connected to the second end portion 17 of the flexible pipe 13 by threading the reducing coupling 29 onto the nipple 27 and then attaching the sprinkler 21 to the reducing coupling 29.

Since the nut 41 has not been fully tightened onto the bolt 43, the pipe clamp 37 is loosely attached around the first end portion 15 of the flexible pipe 13 and the trunion clamp 39, untightened, is free to move around the axis of the bolt 43. Accordingly, the pipe clamp 37 is free to rotate around the first end portion 15 of the flexible pipe 13, and the first end portion 59 of the stiffener bar 35 is free to pivot around the first mounting member 33, slidably engaged in the bore 57 of the trunion clamp 39. Also, since the nut 69 has not been fully tightened onto the bolt 71, the pipe clamp 65 is loosely attached around the second end portion 17 of the flexible pipe 13 and the stiffener bar 35 is free to swivel about the bolt 71. Accordingly, pipe clamp 65 is free to rotate around the second end portion 17 of the flexible pipe 13, and the stiffener bar 35 is free to pivot around the second mounting member 63. In this condition, the sprinkler 21, now connected to the bracing apparatus 31, may be positioned to the desired location (e.g., the position that permits the sprinkler 21 to be positioned into the center of a ceiling tile when installed) by pulling or pushing the second end portion 17 of the flexible pipe 13, vertically, horizontally, and/or laterally as desired to place the sprinkler 21 at the chosen desired location.

At this point, the nuts 41 and 69 may be fully tightened onto bolts 43 and 71 to fully tighten the clamps 37, 39, and 65 to secure the sprinkler 21 in the chosen desired location.

Now, the sprinkler system may be tested for leaks, and any leakage problems may be attended to.

If the sprinkler system is being retrofitted into an existing ceiling, the chosen desired location for the sprinkler 21 is typically the center of an existing ceiling tile. However, if the sprinkler system is for a new ceiling, the ceiling may now be installed. After installation of the new ceiling, the position of the sprinkler 21 may be readjusted, if necessary such that the sprinkler 21 extends through an opening 87 formed in the ceiling 89. This readjustment may be accomplished by sufficiently loosening the tightened nuts 41 and 69 on bolts 43 and 71 to permit the second end portion 17 of the flexible hose 13, with the sprinkler 21 attached thereto, to be pushed or pulled horizontally, vertically, and/or laterally again to permit the sprinkler 21 to be re-positioned to extend through the opening 87 in the ceiling 89. After re-positioning of sprinkler 21, the nuts 41 and 69 may again be fully tightened onto bolts 43 and 71 to secure the sprinkler 21 in its new position. Preferably, in order to lock the position of the sprinkler 21 in place after the sprinkler 21 has been positioned to extend through the opening in the ceiling, the nut 41, after being fully tightened onto bolt 43, is welded to the pipe clamp 37, and the nut 69, after being fully tightened onto bolt 71, is welded to the pipe clamp 65.

Preferably, any excess portion of the first end portion 59 of the stiffener bar 35 extending past the trunion clamp 39 away from the second end portion 68 of the stiffener may be clipped off.

The steps of the inventive method may be interchanged to some extent to accommodate preferences of the installer.

In accordance with the invention, the flexible piping system, with the sprinkler 21 attached thereto, may be installed when the piping system (e.g., the mains, cross mains, and branching lines) is installed. Once the tile contractor installs the ceiling tile, it is an easy matter for a sprinkler fitter to loosen the flexible piping system 11 of the invention, and re-position the sprinkler 21 in the opening cut in the ceiling tile, and re-tighten the flexible piping system 11 to secure the sprinkler 21 in its new location extending through the opening in the ceiling tile.

With the flexible piping system 11 of the invention, replacement ceiling tiles, including the ceiling tile grid, may be installed without the need to drain the pipes of the fire sprinkler system.

The inventive flexible piping system 11, including the sprinkler 21 attached thereto, may be installed and hydro tested in both new and retrofitted construction prior to the installation of the grid system used to support the ceiling tiles. Unlike existing center of tile sprinkler units presently on the market which are supported by the ceiling tile grid system, the inventive flexible piping system 11 does not depend upon the ceiling tile grid system for support.

The flexible piping system 11 of the invention helps prevent pressure spikes or seismic movement from dislodging the sprinkler 21 from its position and/or from its upright position, since the flexible piping system 11 of the invention is not tied into and dependent upon the ceiling tile grid system for support. The inventive flexible piping system 11 ties back to sway bracing when attached to 2½ inch diameter or a larger cross main, thereby minimizing the effect of seismic disturbances.

The invention claimed is:

1. A method of installing a sprinkler of a sprinkler system comprising the steps of:

connecting a first end portion of a flexible pipe to a header pipe, attaching a first mounting member to the first end portion of the flexible pipe such that the first mounting member may be rotated around the first end portion of the flexible pipe until it is secured in place on the flexible pipe, attaching a second mounting member to a second end portion of the flexible pipe such that the second mounting member may be rotated around the second end portion of the flexible pipe until it is secured in place on the flexible pipe, mounting a second end portion of a stiffener bar on the second mounting member such that the stiffener bar may be pivoted around the second mounting member until it is secured in place, attaching a first end portion of the stiffener bar to the first mounting member such that the stiffener bar slidingly engages the first mounting member until the stiffener bar is secured to the first mounting member and such that the stiffener bar may pivot around the first mounting member until the stiffener bar is secured to the first mounting member, connecting a sprinkler to the second end portion of the flexible pipe, moving the sprinkler to a desired location, securing the first mounting member to the first end portion of the flexible hose to prevent the first mounting member from rotating around the first end portion of the flexible hose, securing the first mounting member to the first end portion of the stiffener bar to prevent the stiffener bar from sliding with respect to the first mounting member and to prevent the stiffener bar from pivoting around the first mounting member, and securing the second mounting member to the second end portion of the flexible hose to prevent the second mounting member from rotating around the second end portion of the flexible hose, and securing the second mounting member to the second end portion of the stiffener bar to prevent the stiffener bar from pivoting around the second mounting member.

2. The method of claim 1, further including the step of testing the sprinkler system for leaks prior to installing a ceiling.

3. The method of claim 1, further including the steps of installing a ceiling having an opening formed therein for receiving the sprinkler, adjusting the position of the sprinkler by unsecuring the first mounting member from the first end portion of the flexible hose to permit the first mounting member to rotate around the first end portion of the flexible hose, unsecuring the first mounting member from the first end portion of the stiffener bar to permit the stiffener bar to slidingly engage the first mounting member and to permit the stiffener bar to pivot around the first mounting member, unsecuring the second mounting member from the second end portion of the flexible hose to permit the second mounting member to rotate around the second end portion of the flexible hose, unsecuring the second mounting member from the second end portion of the stiffener bar to permit the stiffener bar to pivot around the second mounting member, and moving the sprinkler to an adjusted position such that the sprinkler passes through an opening in the ceiling, re-securing the first mounting member to the first end portion of the flexible hose to prevent the first mounting member from rotating around the first end portion of the flexible hose, re-securing the first mounting member to the first end portion of the stiffener bar to prevent the stiffener bar from sliding with respect to the first mounting member and to prevent the stiffener bar from pivoting around the first mounting member, re-securing the second mounting member to the second end portion of the flexible hose to prevent the second mounting member from rotating around the second end portion of the flexible hose, and re-securing the second mounting member to the second end portion of the stiffener bar to prevent the stiffener bar from pivoting around the second mounting member.

4. The method of claim 1, the first mounting member comprising:

a first pipe clamp, a trunion clamp, a first nut, and a first bolt having a nut receiving end portion, the first pipe clamp having aligned first and second bolt openings formed therein for receiving the first bolt and having a pipe opening for receiving the first end portion of the flexible pipe, and the trunion clamp having a first bore for slidably receiving a first end portion of the stiffener bar and having a second bore for receiving the first bolt, wherein, when the first end portion of the flexible pipe is positioned in the pipe opening of the first pipe clamp and the first bolt passes through the second bore of the trunion clamp and the first and second bolt openings of the first pipe clamp, the stiffener bar, at a selected location along the length of the stiffener bar, may be compressibly secured in the first bore of the trunion clamp and the first pipe clamp may be compressibly secured around the first end portion of the flexible pipe by sufficiently tightening the first nut onto the nut receiving end portion of the first bolt.

5. The method of claim 1, the stiffener bar having a bore formed in the second end portion thereof, and the second mounting member comprising a second pipe clamp, a second nut, and a second bolt having a nut receiving end portion; and the second pipe clamp having aligned first and second bolt openings formed therein for receiving the second bolt and having a pipe opening for receiving the second end portion of the flexible pipe, wherein, when the second end portion of the flexible pipe is positioned in the pipe opening of the second pipe clamp and the second bolt passes through the bore formed in the second end portion of the stiffener bar and through the second pipe clamp bolt openings, the stiffener bar may be secured in place to prevent pivoting of the stiffener bar around the second mounting member and the second pipe clamp may be compressibly secured around the second end portion of the flexible pipe by sufficiently tightening the second nut onto the nut receiving end portion of the second bolt.

6. The method of claim 3, the first mounting member comprising:

a first pipe clamp, a trunion clamp, a first nut, and a first bolt having a nut receiving end portion, the first pipe clamp having aligned first and second bolt openings formed therein for receiving the first bolt and having a pipe opening for receiving the first end portion of the flexible pipe, and the trunion clamp having a first bore for slidably receiving a first end portion of the stiffener bar and having a second bore for receiving the first bolt, wherein, when the first end portion of the flexible pipe is positioned in the pipe opening of the first pipe clamp and the first bolt passes through the second bore of the trunion clamp and the first and second bolt openings of the first pipe clamp, the stiffener bar, at a selected location along the length of the stiffener bar, may be compressibly secured in the first bore of the trunion clamp and the first pipe clamp may be compressibly secured around the first end portion of the flexible pipe by sufficiently tightening the first nut onto the nut receiving end portion of the first bolt.

7. The method of claim 3, the stiffener bar having a bore formed in the second end portion thereof, and the second mounting member comprising a second pipe clamp, a second nut, and a second bolt having a nut receiving end portion; and the second pipe clamp having aligned first and second bolt openings formed therein for receiving the second bolt and having a pipe opening for receiving the second end portion of the flexible pipe, wherein, when the second end portion of the flexible pipe is positioned in the pipe opening of the second pipe clamp and the second bolt passes through the bore formed in the second end portion of the stiffener bar and through the second pipe clamp bolt openings, the stiffener bar may be secured in place to prevent pivoting of the stiffener bar around the second mounting member and the second pipe clamp may be compressibly secured around the second end portion of the flexible pipe by sufficiently tightening the second nut onto the nut receiving end portion of the second bolt.

8. The method of claim 6, further including the step of welding the first nut to the first pipe clamp.

9. The method of claim 7, further including the step of welding the second nut to the second pipe clamp.

* * * * *